United States Patent [19]

Turini et al.

[11] 4,173,301

[45] Nov. 6, 1979

[54] PNEUMATIC BRAKE

[75] Inventors: Gerhard Turini, Maisach; Alfred Matthies, Munich, both of Fed. Rep. of Germany

[73] Assignee: Siemens Aktiengesellschaft, Berlin & Munich, Fed. Rep. of Germany

[21] Appl. No.: 851,888

[22] Filed: Nov. 16, 1977

[30] Foreign Application Priority Data

Feb. 18, 1977 [DE] Fed. Rep. of Germany ..... 2707170

[51] Int. Cl.[2] ..... B65H 23/08

[52] U.S. Cl. ..... 226/102; 226/195

[58] Field of Search ..... 226/39, 102, 195, 95; 242/75.2; 271/183

[56] References Cited

U.S. PATENT DOCUMENTS 2,753,181 7/1956 Anander ..... 226/95

3,259,288 7/1966 Wassermann ..... 226/195 X 3,321,121 5/1967 Nyberg ..... 226/95

FOREIGN PATENT DOCUMENTS 601816 8/1934 Fed. Rep. of Germany ..... 271/183

*Primary Examiner*—Richard A. Schacher

*Attorney, Agent, or Firm*—Hill, Van Santen, Steadman, Chiara & Simpson

[57] ABSTRACT

A pneumatic brake device for use in electrostatic copier devices to impart a drag to paper moving through the device. The brake device includes a housing having a perforated suction surface functioning as a brake surface. In order to reduce suction loss when only a portion of the brake surface is covered by the paper sheet, various means are disclosed for limiting or preventing airflow through portions of the brake surface not covered by the paper.

4 Claims, 7 Drawing Figures

PNEUMATIC BRAKE

BACKGROUND OF THE INVENTION

1. Field of the Invention

The present invention relates to electrostatic copier or printer devices and particularly to a pneumatic brake for use therein.

2. Prior Art

This invention is directed to a pneumatic brake for use in connection with a data carrier, such as a paper sheet or web, where the data carrier runs over a surface of the brake element. The surface contains suction orifices through which air is sucked by a suction device.

Pneumatic brakes are conveniently employed to decelerate data carriers such as paper webs. In this, the data carrier passes over a brake surface equipped with suction orifices. Thus the data carrier can be sucked into contact with the brake surface in order to decelerate it. The surface into which the data carrier is brought into contact is herein called the brake surface. Uses of data carriers for this purpose may be found in prior art nonmechanical printers and copiers. In such constructions the data carrier may be provided with a toner image which must pass through a toner fixing station. In passing through the toner fixing station, the toner image is fused onto the data carrier.

Data fixing stations of the type used in connection with nonmechanical printers or electrostatic devices may consist of two opposed fixing cylinders, at least one of which is heated. A preheater device can be positioned upstream of the fixing cylinders in the direction of movement of the paper web. Such preheating devices may for example be a heatable saddle such as shown in U.S. Pat. No. 3,861,863.

Proper functioning of the fixing process requires that the data carrier be in intimate contact with the saddle. In order to provide the desired contact, the data carrier must be tensioned over the saddle. In order to tension the data carrier, it is known to position a pneumatic brake in front of the saddle, upstream thereof in the direction of motion of the data carrier. Downstream of the saddle a data carrier transfer device or propulsion device may be provided.

In applications of this type, the pneumatic brake has a great advantage in that the data carrier is sucked into contact with the brake surface and is thereby decelerated with the pneumatic brake engaging only the underside of the data carrier. The other side of the data carrier is then left unaffected by the brake and may therefore be used as the side on which the toner images are formed. In this manner the brake does not adversely affect such images prior to their fixing.

In order to provide uniform deceleration for data carriers of different widths, it is convenient to match the width of the brake surface containing the suction orifices to the width of the data carrier. In other words if the width of the data carrier changes, for example if it becomes smaller, then it will no longer cover all of the suction orifices in the brake surface. When this occurs the vacuum level in the pneumatic brake device decreases and the braking effect per suction orifice is lessened. It would therefore be an advance in the art to provide a pneumatic brake of the type described which reduces or eliminates the heretofore experienced loss in braking force per suction orifice occasioned by changing data carrier widths.

SUMMARY OF THE INVENTION

It is therefore the principle object of this invention to provide a pneumatic brake device which operates properly when utilizing data carriers having a width less than the width of the brake surface.

In this context one aim of this invention is to avoid components which extend substantially beyond the dimensions of the pneumatic brake which are defined by the maximum width of the data carrier.

These objects are achieved in the present invention by virtue of the fact the pneumatic brake is designed such that the suction effect can be inhibited in localized sections distributed across the width of the brake surface. The effective width of the brake element can thus be adapted to the width of the data carrier.

The interior of the pneumatic brake which forms part of the brake system can be subdivided into chambers, such as, by use of partition walls between the sub-chambers. The sub-chamber partition walls can then be provided with perforated diaphragms or openings through which airflow between the individual chambers can occur. A suction device is then connected to one of the chambers along one exterior side of the brake device. Thus when a narrower data carrier is being passed over the braking surface the pressure loss in the interior sub-chambers which are covered by the data carrier will be minimized because the openings between the sub-chambers provide a relatively small cross-sectional area for air leakage.

In a modified form of the invention the openings in the partitions can be provided with flap members which can cover the openings. The flap members may be hinged or rotatable with respect to the partition walls. In this, it is preferred, in one embodiment, to provide a rotating spindle which passes through the pneumatic brake. The flaps can then be staggered on the spindle. The flaps are preferably spring loaded towards the partition walls which divide the sub-chambers and are dimensioned to be able to close off the openings therethrough. By rotating the spindle, successive openings can be sequentially closed off.

In yet another embodiment, the pneumatic brake can be provided with a slidable plate member positioned underlying the brake surface. The plate member can have a dimension less than the full width of the brake surface and can therefore be displaceable transverse the brake element, internally thereof, from a first position in which the plate is adjacent to or contacts one side edge of the brake element to a second position in which the plate is closer to, or adjacent, or in contact with, the other side edge. By equipping the plate with openings therethrough the plate can be used to control suction orifice openings in the brake surface. Thus, preferably, the plate has openings which, when the plate is in the first position are aligned with and in communication with the openings in the brake surface. The openings in the plate commencing from that end of the plate which is closest to the first position of the plate are differently sized. The first openings have a dimension equal to the diameter of the suction orifices in the brake surface. Then, moving further across the width of the brake element, the openings change into elongated holes whose lengths correspond to twice and then three and then four times, etc. the diameter of the suction orifices. The elongated holes viewed from the side of the brake element representing the first position of the brake extend towards that side from the position of initial underlying of the brake surface orifices. In this manner, by moving the plate away from the first position, brake surface orifices will be sequentially blocked across the width of the plate. In one move of the plate equal to one diameter of the brake surface orifices, those brake surface orifices which are underlied by a single diameter plate orifices will be closed off but those which are underlined by two diameter and three diameter etc. elongated holes will not be blocked off. A movement of the plate of two brake surface orifice diameters will then sequentially cut off the next set of brake surface orifices which were initially underlied by elongated holes having a diameter of twice the brake surface orifice diameter.

In yet another embodiment, a rotatable spindle may be disposed in the brake across the width thereof. The spindle may be equipped with a slider element. The slider element will have a cross section substantially that of the interior of the brake. Thus by rotation of the spindle the slider element can be moved through the interior of the brake. As a consequence the interior space of the brake can be divided proportionally into areas on either side of the slider. By having the suction orifice open to only one side, the effective area of the pneumatic brake can be matched to the width of the data carrier.

It is therefore an object of this invention to provide a improved pneumatic brake for use in nonmechanical printers and copiers, and particularly for use in electrostatic devices.

It is yet another object of this invention to provide a pneumatic brake comprising a vacuum box having a top brake surface with a plurality of suction orifices therethrough and means interior of the vacuum box limiting airflow through those suction orifices which are not covered by a data carrier being tensioned by the pneumatic brake.

It is another specific object of this invention to provide a pneumatic brake for electrostatic copier and printer devices which includes a vacuum housing divided into sub-chambers by interior partition walls with a brake surface having orifices open to the chambers, the partition walls having relatively small diameter openings therethrough, limiting suction flow between adjacent chambers and wherein the chambers may, if desired, be equipped with flap members for selectively closing off communication between selected adjacent chambers.

It is another specific object of this invention to provide a pneumatic brake for use in electrostatic devices having a vacuum chamber with a brake surface having a plurality of orifices therethrough open to the interior of the vacuum chamber and sliding means positioned within the vacuum chamber for selectively blocking suction flow through some of the brake surface orifices.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
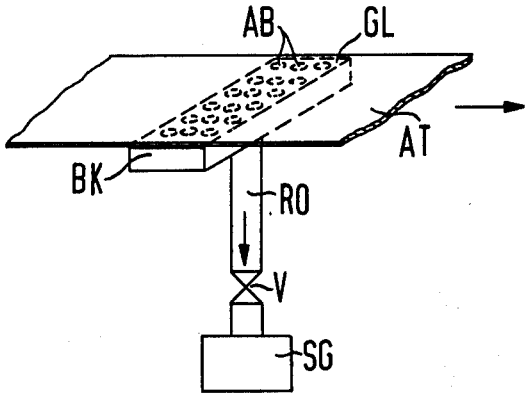
FIG. 1 is a fragmentary schematic view of a pneumatic brake.

FIG. 1 schemmatically illustrates the basic design o a pneumatic brake of the type disclosed, for example, in the aforementioned U.S. Pat. No. 3,861,863. The pneumatic brake consists of a brake element of vacuum chamber BK having a hollow interior. The top of the brake element BK is closed by a brake surface GL which contains suction orifices AB therethrough. The suction orifices AB extend across the full width of the brake surface. A data carrier AT is moved across the brake surface GL. The brake element BK is attached operatively to a suction device SG which draws air in the direction of the arrow from the vacuum chamber brake element BK.

For the purpose of drawing air a pipe RO may be in communication with the vacuum chamber BK and be connected, for example through a valve, V, to the suction device SG. The suction device and the valve do not form any part of this invention and will therefore not be further described since such devices are well within the skill of the art.

As shown in FIG. 1, the width of the data carrier AT ideally corresponds to the full width of the brake surface GL or at least that portion of the brake surface GL which has suction orifices AB therethrough. When this occurs all of the suction orifices will be closed by the data carrier AT. When air is then withdrawn from the vacuum chamber BK the pressure within the vacuum chamber will drop such that the data carrier AT will be sucked into contact with the brake surface GL and will therefore be decelerated. In this manner the data carrier will be drawn into contact with the brake surface GL of the vacuum chamber BK with a force which is proportional to the vacuum and the cross-sectional area of the orifices AB. Therefore the data carrier AT will be declerated with a force which is proportional to the drawing force and the coefficient of friction between the data carrier and the brake surface.

If, however, the width of the data carrier is less than that of the brake surface equipped with suction orifices AB, then some of the suction orifices will not be covered by the data carrier. A constant flow of bypass air will occur through the uncovered orifices AB and be drawn into the interior. This will consequently reduce the vacuum pressure within the vacuum chamber BK thereby impairing the braking efficiency of the device.

Figure 2:
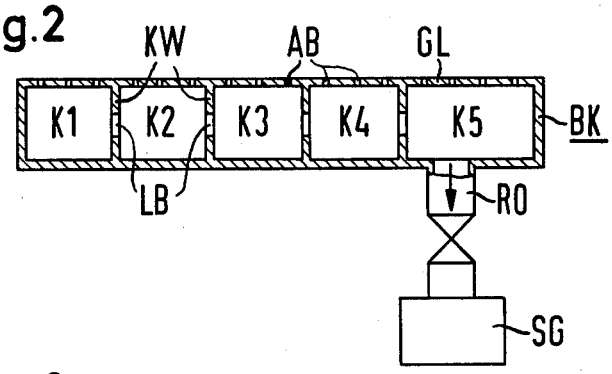
FIG. 2 is a cross-sectional view of a first embodiment of a pneumatic brake according to this invention.

FIG. 2 illustrates a first embodiment of a pneumatic brake according to this invention in which the brake efficiency will be maintained even when using a data carrier which does not cover the full width of the suction orifice area of the brake surface. The vacuum chamber BH is divided into individual subchambers K1 through K5 by means of partition walls KW. Perforated openings or diaphragms LB are provided through the partition walls KW. Preferably the openings LB have a relatively small cross section. One of the external side chambers, chamber K5 in the illustrated embodiment is connected to the pipe RO leading to the suction device SG.

When a narrow data carrier is used in connection with the embodiment of FIG. 2 thereby allowing a part of the vacuum chamber to be uncovered, the pressure loss in those chambers which are covered by the data carrier will be small because of the fact that the opening through the partition at the area of transition from a covered chamber to an uncovered chamber will offer only a small cross-sectional area to pass leakage air. In order for this device to be effective, the data carrier should always cover the outer chamber which is connected to the suction device.

Preferably the cross section area of the partition openings LB should both be small enough that, when narrow data carriers are being used, the pressure drop between adjacent chambers is maintained within desired limits and also large enough such that in those chambers which are covered with the data carrier there is sufficient suction to compensate for the unavoidable air leakage losses which occur due to the fact that the data carrier does not seat flush on the braking surface and further may exhibit to a greater or lesser extent some porosity. One particular advantage of the embodiment shown in FIG. 2 is the fact that no adjustments are required within the brake element when the width of the data carrier is changed.

Figure 3:
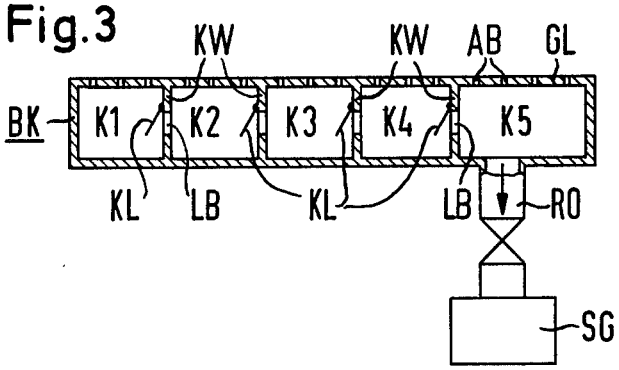
FIG. 3 is a view similar to FIG. 2 showing anothe: embodiment of the pneumatic brake of this invention.

A second embodiment is illustrated in FIG. 3. This figure corresponds essentially with the embodiment of FIG. 2 except that the openings LB are provided with flaps KL. The flaps can be pivotably attached to the partition walls between the chambers. The openings LB can now be closed by the flaps KL so that pressure loss due to the existence of chambers which are not fully covered by the paper can be entirely avoided. The openings LB are made sufficiently large to compensate for pressure loss which arises due to improper seating of the data carrier or to the porosity of the data carrier.

The flaps KL can be actuated by mechanical or electrical means, either manually or automatically. For example flaps KL can be connected through rod members to solenoid armatures which will open or close depending upon how the flaps are driven.

Figure 4:
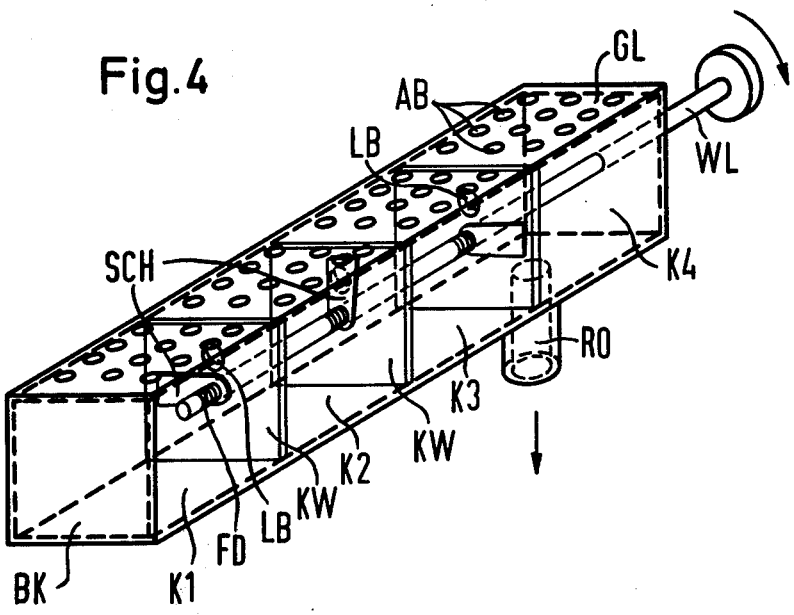
FIG. 4 is a perspective view of another embodimen of a brake according to this invention, the figure illus trates underlying portions disposed interiorly of th brake.

A further modification of the embodiment of FIG. 2 is shown in FIG. 4. Once again the vacuum chamber BK is divided into sub-chambers K1 through K4. The connection to the suction device SG is through the chamber K4 by means of pipe RO. The partition walls KW between the chambers are again provided with openings LB through which the individual chambers are in communication with one another.

In the longitudinal direction of the vacuum chamber BK, that is along the width, normal to the direction of movement of the paper, a spindle WL is provided which passes through the vacuum chamber BK and through or into the individual sub-chambers. The spindle WL is equipped with flaps or slider elements SCH which are spring loaded to abut against the partition walls KW. The spring load on each of the elements SCH can, for example, be generated by means of coil springs FD although it is equally possible to preload the elements SCH such that they seat resiliently against the partition walls KW.

The individual elements SCH are positioned in a rotatably staggered relationship on the spindle WL. For example, the elements SCH can be offset from one another by 90°. If the spindle WL is then rotated, the chambers can be switched in or switched out successively. The position of the spindle WL shown in FIG. 4 is such that the opening in the partition wall between chambers K3 and K2 is closed by the element SCH which covers the partition opening. Chambers K1 and K2 will be therefore isolated from chambers K3 and K4. Thus the openings AB through the brake surface GL which lie above the chambers K1 and K2 will be closed off from the suction source and be inoperative. Rotation of the spindle WL can be performed manually or, if desired, can be automatically controlled and, for example, can be synchronous with other units of the device in which the pneumatic brake is installed. Such other units might for example be a paper feed device or a stacker unit from which the paper width size will be known.

Figure 5:
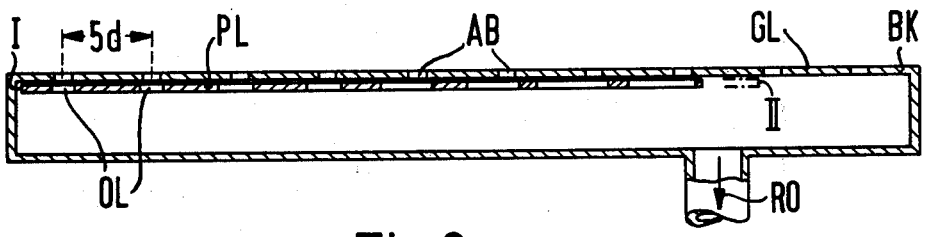
FIG. 5 is a view similar to FIGS. 2 and 4 illustrating yet another embodiment of this invention.
Figure 6:
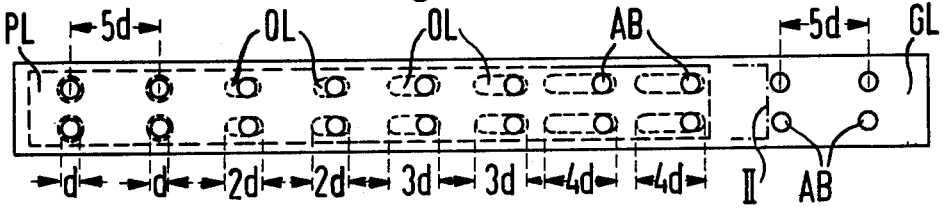
FIG. 6 is a top plan view of the embodiment of FIG 5 illustrating underlying portions by broken lines.

FIGS. 5 and 6 illustrate yet another embodiment of this invention. FIG. 5 is a longitudinal section through the vacuum housing of the pneumatic brake while FIG. 6 is a plan view thereof.

A displaceable plate PL is positioned within the vacuum chamber DK underlying the brake surface GL. The plate PL has a length which is smaller than the width of the brake surface GL as illustrated in FIGS. 5 and 6. Thus, the plate PL can be displaced across the width of the brake surface from a first position I to a second position II. The plate PL is provided with openings OL. When the plate PL is in its first position I, the openings OL are located below the orifices KB in the brake surface GL. In this instance, with the plate PL in the first position, all of the suction orifices AB in the brake surface GL will be in communication through the plate orifices to the interior of the vacuum chamber BK.

The diameter of the openings OL correspond, as viewed from that end of the plate adjacent the first position I, first to the diameter D of the orifices in the brake surface GL and then, as spaced in the direction of the second position II, the openings OL become elongated holes which have a length of *2d, 3d, 4d* etc. where "d" is substantially the diameter of the openings AB in the brake surface GL. The elongated holes, when the plate is in the first position I, extend from a position underlying the openings AB at one end of the elongated hole towards the end of the plate at the first position I.

In the example shown in FIGS. 5 and 6, the length of the openings OL in the plate PL are extended to a maximum of *4d*. The interval between suction openings AB must then be at least *5d*. By displacing the plate PL from position I to position II, suction orifices AB are progressively closed off, commencing with those orifices closest adjacent the position I. In this manner the effective width of the pneumatic brake can be altered. The special design of the openings OL and the plate PL is such that progressively more and more openings AB in the brake surface GL can be closed off. In FIGS. 5 and 6 only two parallel rows of openings GL and of orivices AB are shown. Obviously the brake surface GL and the plate PL may be equipped with a greater number of parallel rows of openings.

Figure 7:
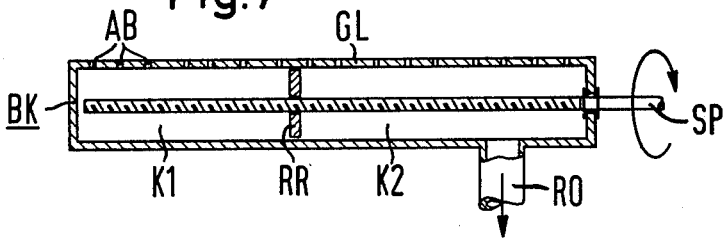
FIG. 7 is a view similar to FIGS. 2 and 3 illustrating yet another embodiment of this invention.

FIG. 7 illustrates yet another embodiment of the pneumatic brake of this invention. The figures once again illustrates a longitudinal section through the vacuum chamber BK. A spindle SP is disposed within the vacuum chamber BK. A slider element RR is attached to the spindle such that rotation of the spindle will cause the slider element RR to be moved longitudinally within the vacuum chamber BK. The design of the slider element RR is chosen such that its cross-sectional area corresponds substantially to the cross section of the interior of the vacuum chamber BK. Thus, the vacuum chamber BK will be subdivided into two chambers K1, K2 by the slider element. The dimensioning of the chambers K1, K2 is dependent upon the position of the slider element RR within the vacuum chamber. Therefore, by moving the slider element RR either the effective chamber K2 open to the suction through pipe RO or the ineffective chamber K1 on the other side of the slider RR from the pipe RO can be made the larger chamber. Once again the pipe RO has been located adjacent one end of the vacuum chamber BK. It will, therefore, be apparent that by rotation of the spindle SP the effective area of the brake surface through which suction is being applied to the data carrier can be effectively changed to correspond with the width of the data carrier.

One major advantage of the pneumatic brake designs according to this invention is the fact that the effective area of the brake surface can be adjusted without requiring components which project essentially beyond the maximum width of the data carrier. Additionally the constructions shown do not effect the brake surface itself other than to regulate suction.

Although the teachings of our invention have herein been discussed with reference to specific theories and embodiments, it is to be understood that these are by way of illustration only and that others may wish to utilize our invention in different designs or applications.

We claim as our invention:

1. In a pneumatic brake assembly for tensioning a data carrier in an electrostatic printing device where the data carrier passes over a brake surface of the pneumatic brake in contact therewith across substantially the full width of the data carrier, with a suction force being applied at the brake surface to draw the data carrier to the brake surface, the improvement of: the pneumatic brake including an enclosed vacuum chamber having at least one side thereof fromed by the brake surface, a plurality of suction orifices through the brake surface communicating to an interior of the vacuum chamber, the vacuum chamber being connected to a suction source, suction inhibiting means in the vacuum chamber, the orifices through the brake surface being distributed across the full width of the brake surface, the suction inhibiting means being such that the effective width of the brake element can be adopted to the width of the data carrier passing thereover without adverse reduction of the suction effect through the orifices covered by the data carrier when portions of the brake surface are not covered by the data carrier, the vacuum chamber being subdivided into subchambers by internal partition walls, each of the subchambers open to some of the brake surface orifices, the subchambers being connected to one another through openings in the partition walls between adjacent subchambers, the suction device being connected to a subchamber located at one side end of the vacuum chamber, the side end being adjacent a transverse edge of the data carrier passing over the pneumatic brake, the openings in the partition walls being of limited cross-section area effective to provide a pressure drop between adjacent chambers when one of the subchambers has a data carrier overlying the portion of the brake surface associated with a first of said adjacent subchambers and another of said adjacent subchambers does not have a data carrier overlying the portion of said brake surface associated with said another of said adjacent subchambers whereby an effective negative pressure is maintained in the first of said subchambers, the partition walls extending along the length of the vacuum chamber in a direction parallel to a path of movement of the data carrier along the brake surface, the vacuum chamber being closed except through the orifices and the connection to the suction device, there being a plurality of partition walls and subchambers transverse the width of the vacuum chamber.

2. The device of claim 1 wherein flap means pivotably attached the partition walls are provided for closing the partition wall openings.

3. The device of claim 2 wherein the flap means are positioned on the side of the partition walls opposite the suction device connection to the one subchamber.

4. The device of claim 1 wherein flap means are provided for closing the partition wall openings, the flap means being rotatable and attached to a common shaft, the flaps for each partition wall being angularly offset on the shaft from the flaps of other walls.

* * * * *